United States Patent [19]

Stage

[11] Patent Number: 4,901,959

[45] Date of Patent: Feb. 20, 1990

[54] COLLAPSIBLE SUPPORT STAND FOR FLEXIBLE TRASH BAG

[76] Inventor: Jack W. Stage, 100 Mount Lyell Dr., San Rafael, Calif. 94903

[21] Appl. No.: 224,390

[22] Filed: Jul. 26, 1988

[51] Int. Cl.[4] ..... A63B 55/04

[52] U.S. Cl. ..... 248/97; 220/4 E; 220/401; 220/404; 248/99; 248/101; 248/150

[58] Field of Search ..... 248/95, 97, 98, 99, 248/100, 101, 150, 153; 220/4 E, 401, 403, 404, 1 T

[56] References Cited

U.S. PATENT DOCUMENTS

| | | | |
|---|---|---|---|
| 1,858,649 | 5/1932 | Weakley | 248/101 X |
| 2,304,810 | 12/1942 | Fetterman | 248/153 |
| 3,604,677 | 9/1971 | Gits | 248/150 X |
| 3,627,242 | 12/1971 | Vandermast | 248/153 X |
| 4,157,801 | 6/1979 | Elmer | 248/97 |
| 4,537,376 | 8/1985 | Buku | 248/97 |
| 4,586,619 | 5/1986 | Eckert | 211/194 X |

FOREIGN PATENT DOCUMENTS

| | | | |
|---|---|---|---|
| 2177996 | 2/1987 | United Kingdom | 248/97 |

*Primary Examiner*—Alvin C. Chin-Shue
*Assistant Examiner*—David L. Talbott
*Attorney, Agent, or Firm*—Melvin R. Stidham

[57] ABSTRACT

A trash bag support stand is formed of two semi-circular bars, secured together on a pair of legs. Complementary coupling components on the ends of the bars are snapped together to form complete rings that are supported horizontally above the ground to receive and emcompass a trash bag. The trash bag is folded back over the top ring and held in place by tabs. When not in use the semi-circular bars are separated and nested for hanging.

2 Claims, 1 Drawing Sheet

COLLAPSIBLE SUPPORT STAND FOR FLEXIBLE TRASH BAG

BACKGROUND OF THE INVENTION

Large bags of a thin, tear-resistant plastic are widely used for gathering trash, such as debris, leaves, grass and shrub cuttings and the like. Such bags, when filled, are simply closed and tied and disposed of with the trash therein. The difficulty is in holding the limp, flexible bag open and upright to receive the trash. There are presently available trash bag supports for this purpose but there is a need for a simple structure that may conveniently be stored when not in use, that is easily assembled for use; and is inexpensive enough to justify its purchase for limited use.

Trash bag supports of the type shown in Vandermast U.S. Pat. No. 3,627,242 have to be assembled for use by repositioning the legs and adding and securing a reinforcing ring around the legs when the device is moved from a place of storage and put into service. In Gits U.S. Pat. No. 3,604,677, a support ring is secured to hooks at the tops of stakes and the stakes then driven into the ground to support a flexible bag.

OBJECTS OF THE INVENTION

It is an object of this invention to provide a support stand for a disposable trash bag that is easily assembled for use.

It is a further object of this invention to provide a support stand for a trash bag that is easily disassembled and separated into components that may be nested in a compact package for storage.

Other objects and advantages of this invention will become apparent from the description to follow, particularly when read in conjunction with the accompanying drawing.

SUMMARY OF THE INVENTION

In carrying out this invention I provide a pair of horizontal rings that are mounted on legs to support the mouth of the bag above the ground. The bag is received within the rings, folded back over the top ring and secured in upright raised position to facilitate filling. The rings are joined together and formed in two separable semi-circular sections so that, after use, the rings can be separated and nested for storage, as by hanging them from a hook or nail.

DESCRIPTION OF A PREFERRED EMBODIMENT

Figure 1:
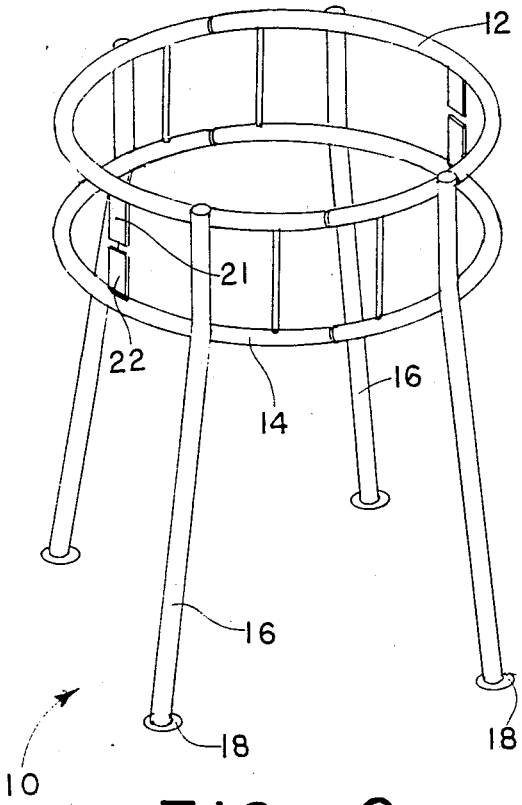
FIG. 1 is a view in perspective of an assembled trash bag holder.

Referring to the drawing with greater particularity, the trash bag support stand 10 of this invention comprises a pair of horizontal rings 12 and 14 secured to legs 16 so that the rings 12 and 14 are positioned above the ground when in use. Feet 18 are preferably provided on the legs to enable them to be supported without penetrating the surface of the ground.

Figure 2:
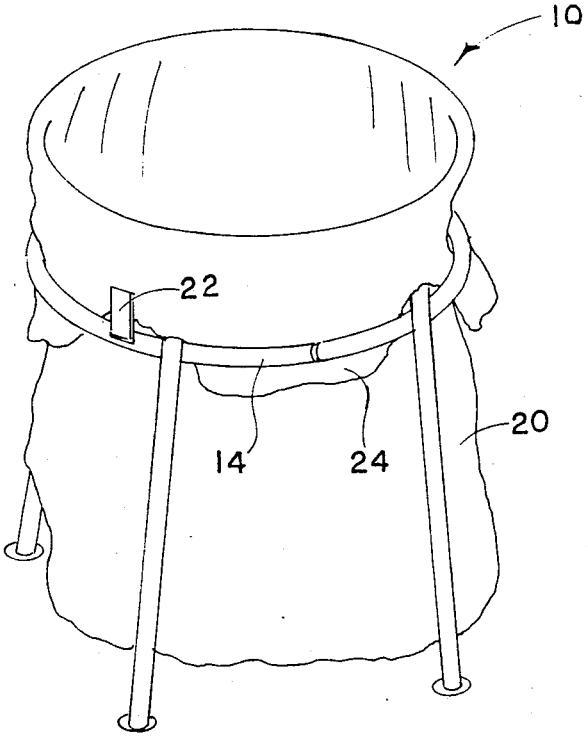
FIG. 2 is a view in perspective of the trash bag holder in use.

With the rings so positioned, a conventional trash bag 20 (FIG. 2) may be disposed within the rings 12 and 14 so as to be encompassed thereby, and then folded back over the top ring 12 and with the edge portion 24 of the bag being inserted between each of two pairs of tabs 21 and 22 which grip the folded-back top portion 24 of the bag 20 to hold it in place. In this position, the bag 20 is upright and fully opened so that leaves, yard cuttings and other trash can easily be thrown or dropped in. When the bag 20 is filled, the edges 24 around the open end are simply pulled from between the tabs 21 and 22 and gathered together. Then a suitable tie may be wrapped around the open end 24, to hold it closed so that the filled bag may be disposed of without spilling the trash therein.

Figure 3:
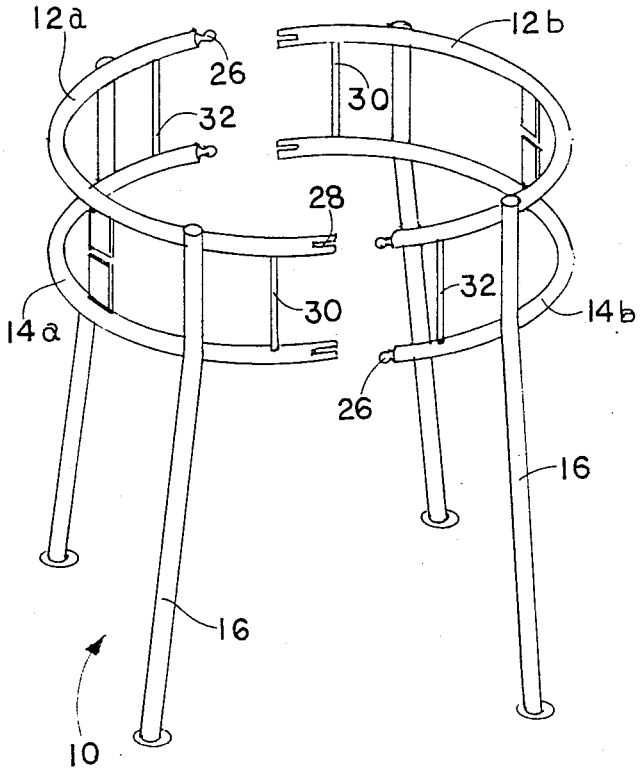
FIG. 3 is a view in perspective of the trash bag holder separated in sections for storage.
Figure 4:
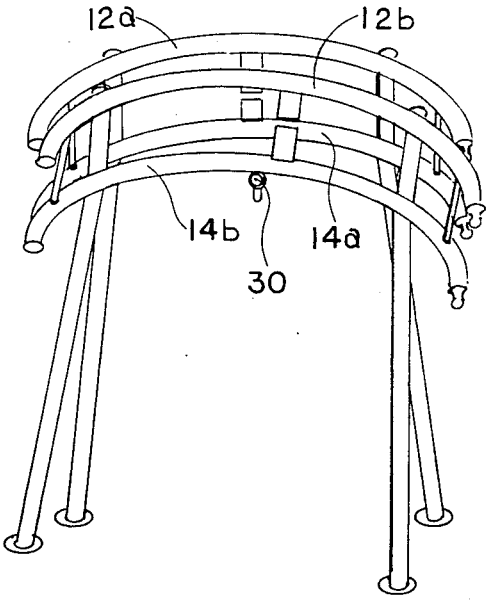
FIG. 4 is a view in perspective of the sections nested for storage.

The horizontal support rings 12 and 14 are formed in two sections **12*a*, 12*b* and 14*a*, 14*b*, each section having complementary male 26 and female 28 components of a releasable coupling. Additional cross braces 30 and 32 are provided between the semi-circular sections 12*a* and 12*b* to ensure proper alignment of the coupling components 26 and 28. Hence, the coupling components 26 and 28 are easily snapped together to assemble the rings 12 and 14 for use and, after use, the components are readily separated, as shown in FIG. 3 so that one section 12*b*, 14*b* can simply be reversed and nested into the other seciton 12*a*, 14*a* and the nested sections stored, as by hanging them on a suitable hook or nail 30 (FIG. 4**) for future use.

While this invention has been described in conjunction with a preferred embodiment thereof, it obvious that modifications and changes therein may be made by those skilled in the art to which it pertains without departing from the spirit and scope of this invention, as defined by the claims appended hereto.

What is claimed as invention is:

1. A support stand for a flexible trash bag comprising:

a pair of top and bottom rings;

four support legs supporting said rings above the ground in generally horizontal position;

each of said rings being formed in just two identical approximately semi-circular sections, with two of said support legs fixed to and joining each pair of parallel semi-circular sections in parallel relationship; and complementary male and female coupling means releasably joining the ends of said semi-circular sections, the male coupling means being at one end and the female coupling means being at the other end of each semi-circular section.

2. The support stand defined by claim 1 including:

a pair of rigid tabs on each of said semi-circular sections extending toward each other so that the mouth of a bag can be received within said top and bottom rings and folded over said top ring and inserted between said tabs.

* * * * *